US006568916B2

(12) United States Patent
Nelson et al.

(10) Patent No.: US 6,568,916 B2
(45) Date of Patent: May 27, 2003

(54) AXIAL PISTON PUMP WITH OUTER DIAMETER INLET FILLING

(75) Inventors: Bryan E. Nelson, Lacon, IL (US); Eric S. Keyster, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/876,496

(22) Filed: Jun. 7, 2001

(65) Prior Publication Data

US 2002/0187055 A1 Dec. 12, 2002

(51) Int. Cl.[7] ..... F04B 1/12; F04B 27/08

(52) U.S. Cl. ..... 417/269; 417/284; 417/495; 123/289

(58) Field of Search ..... 417/269, 270, 417/283, 284, 289, 490, 494, 495, 63; 123/446, 447, 506, 299, 300; 91/499; 92/12.2

(56) References Cited

U.S. PATENT DOCUMENTS 3,827,337 A * 8/1974 Pruvot ..... 91/489
3,890,883 A * 6/1975 Rometsch et al. ..... 91/449
4,579,043 A * 4/1986 Nikolaus et al. ..... 91/499
5,205,124 A * 4/1993 Budzich, deceased ..... 60/456
5,603,609 A * 2/1997 Kadlicko ..... 417/63
6,035,828 A * 3/2000 Anderson et al. ..... 123/446

FOREIGN PATENT DOCUMENTS

JP 10266947 * 10/1998

* cited by examiner

*Primary Examiner*—Charles G. Freay
*Assistant Examiner*—Han L. Liu
(74) *Attorney, Agent, or Firm*—Liell & McNeil

(57) ABSTRACT

A variable delivery fixed displacement pump is provided which has a rotating drive plate with a fixed angle. The drive plate has a fill passage extending between its radial outer surface and its drive surface, which allows fluid to be supplied to a fluid journal bearing. The drive plate also has a series of bearing supply passages which fluidly connect the drive surface of the drive plate with a base surface, allowing fluid to be supplied to a fluid thrust bearing. A method of pumping fluid is also provided which is comprised of the steps of reciprocating a plurality of pistons at least in part by rotating the drive plate, and by fluidly connecting a pumping chamber of the pistons to an annular groove that is part of the drive plate fill passage.

20 Claims, 2 Drawing Sheets

AXIAL PISTON PUMP WITH OUTER DIAMETER INLET FILLING

TECHNICAL FIELD

The present invention relates generally to axial piston pumps, and more particularly to a variable delivery axial piston pump with outer diameter inlet filling via a fixed angle drive plate.

BACKGROUND

The invention described in U.S. Pat. No. 6,035,828 to Anderson et al. shows a variable delivery fixed displacement pump. Anderson also discloses a fixed angle drive plate and an electronic control unit which can alter the effective fluid displacement achieved by each pumping stroke. This design has met with tremendous success and represents a substantial improvement over earlier systems, however, there remains room for improvement.

For instance, the drive plate in Anderson is mounted on frustoconical roller bearings to ensure smooth rotation. While this design achieves its intended purpose, a significant amount of engine torque is wasted in overcoming the roller bearings' friction. In addition, frustoconical bearings are relatively expensive and subject to failure like any other moveable metallic component. It would thus be desirable to reduce the cost and the friction between the drive plate and the pump housing. In addition, refilling of the hollow piston interiors takes place by drawing fluid from the pump's low pressure interior via an opening in the outer radius of the drive plate. Consequently, engine power used to supply the pump with hydraulic fluid is less than fully exploited, resulting in a reduction in efficiency. It would thus be desirable to employ a design which takes advantage of the hydraulic fluid inlet pressure.

The present invention is directed to overcoming one or more of the problems or disadvantages set forth above.

SUMMARY OF THE INVENTION

In one aspect, a drive plate for an axial piston pump is provided which comprises a metallic component having a centerline and a drive surface oriented at a drive angle that is different from 90 degrees relative to the centerline. The metallic component further includes a radial outer surface surrounding the centerline, and defines a fill passage that extends between the radial outer surface and the drive surface. The fill passage includes an annular groove that is defined by the radial outer surface.

In another aspect, a pump is provided which comprises a housing defining an inlet. A plurality of pistons are provided, each defining a hollow interior, and are arranged around a centerline. A rotatable drive plate is also provided and defines a fill passage extending between a radial outer surface and a drive surface. The hollow interiors of the plurality of pistons are in fluid communication with the inlet via an annular groove defined by at least one of the housing and the drive plate.

In still another aspect, a method of pumping fluid is provided which comprises the step of reciprocating a plurality of pistons at least in part by rotating a drive plate. The method also includes the step of fluidly connecting a pumping chamber of a portion of the pistons to an inlet via an annular groove that is a portion of a fill passage extending between a radial outer surface and a drive surface of the drive plate. The method also includes the step of fluidly connecting a pumping chamber of a different portion of the pistons to an outlet.

DETAILED DESCRIPTION

Figure 1:
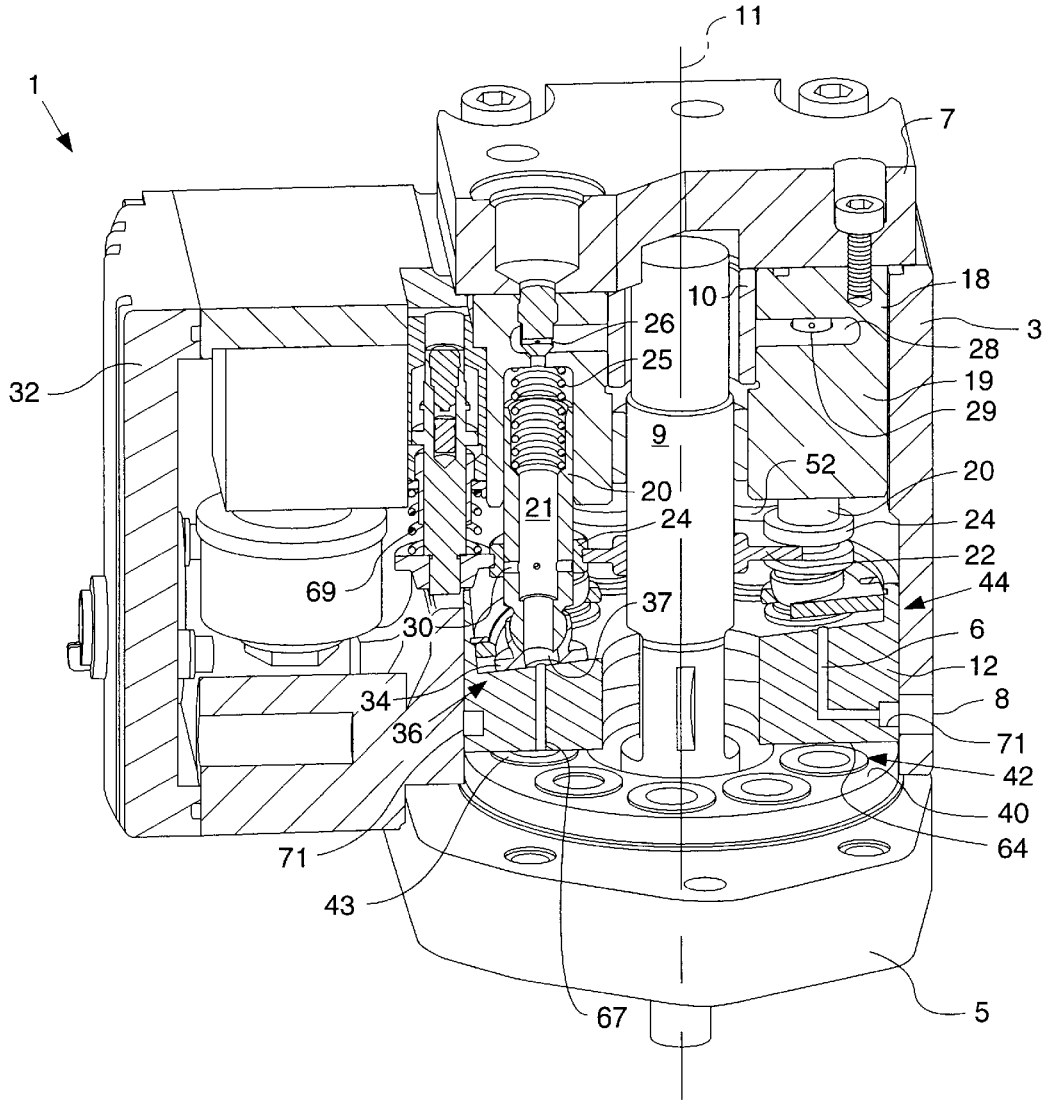
FIG. 1 is a partial sectioned diagrammatic isometric view of a pump according to the present invention.

Referring to FIG. 1, there is shown an axial piston pump 1 according to the present invention. Pump 1 includes a housing 3 and an electro-hydraulic control unit 32. A front flange 5 and an end cap 7 are provided, and are attached to housing 3 at opposite ends. An inlet 8 which is defined by housing 3 allows hydraulic fluid to be supplied to pump 1 from an exterior source (not shown). A barrel assembly 18 is provided which includes a barrel 19 positioned at least partially within housing 3 that is preferably adjacent one end of a plurality of pistons 20. A drive plate 12, which is preferably metallic, is positioned adjacent the opposite end. A rotatable drive shaft 9 is attached to drive plate 12, and is supported by a bearing collar 10. Drive shaft 9 is preferably coupled directly to the output of an engine (not shown), such that the rotation rate of shaft 9 and drive plate 12 is directly proportional to the rotation rate of the engine drive shaft.

In the preferred embodiment, the plurality of pistons 20 are arranged in a parallel orientation around centerline 11. Bach individual piston 20 defines e hollow interior 21, and is attached via a ball joint 36 to a shoe 34 that is positioned in contact with drive plate 12. Hollow interior 21 is a portion of the pumping chamber for the piston. Return springs 25 continuously urge each piston 20 toward drive plate 12 in a conventional manner such that the piston shoes 34 remain in continuous contact with drive plate 12. Drive plate 12 has a fixed angle, $\beta$ (see FIG. 3), and its rotation causes the plurality of pistons 20 to serially reciprocate between an up and a down position, displacing fluid in a conventional manner. Because each piston shoe 34 is maintained in contact with the drive plate, the pistons' hollow interiors 21 can allow fluid supplied via drive plate 12 (described below) to flow from an opening 37 in each shoe 34 to the opposite end of the piston 20. From this point, the fluid can be forced past a check valve 26 into a collector ring 28, and from there to an outlet via an outlet passage 29.

A sleeve 24 is movably mounted around each of the plurality of pistons 20. The sleeves' 24 position determines the proportion of displaced fluid flowing to collector ring 28, and the proportion which flows to the low pressure interior 52 of pump 1. Each sleeve 24 is attached to a connector 22 which surrounds drive shaft 9. Connector 22 is movable between an up and a down position by electro-hydraulic control unit 32 in a conventional manner, allowing simultaneous movement of all the sleeves 24. When the sleeves 24 are in their down position, a plurality of spill ports 30 can fluidly connect the hollow piston interiors 21 to low pressure interior 52 when the pistons 20 travel upward during a pumping stroke. In their up position, sleeves 24 cover the spill ports 30 and allow pressure to build in the piston interiors 21, resulting in a relatively greater proportion of fluid being forced past check valve 26 and into collector ring 28 by the pistons' 20 pumping action. Because electro-hydraulic control unit 32 can be used to control the vertical position of each sleeve 24 on its respective piston 20, the relative discharge of pump 1 can be controlled by selectively allowing sleeves 24 to cover or uncover the spill ports 30 during different portions of a piston pumping stroke. Electro-hydraulic control unit 32 defaults when un-energized via spring 69 to bias the piston sleeves 24 in their down position, at which the pump produces no high pressure output.

Figure 4:
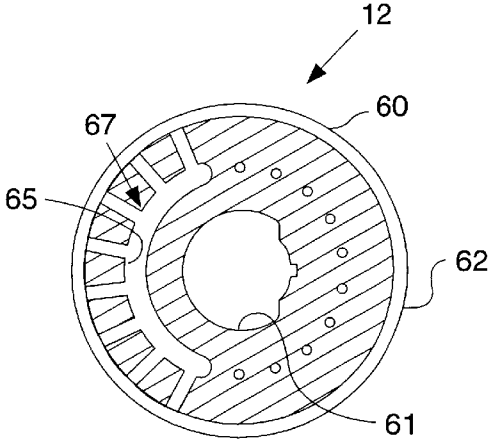
FIG. 4 is a sectioned bottom view of the drive plate as viewed along section line 4—4 of FIG. 3.
Figure 3:
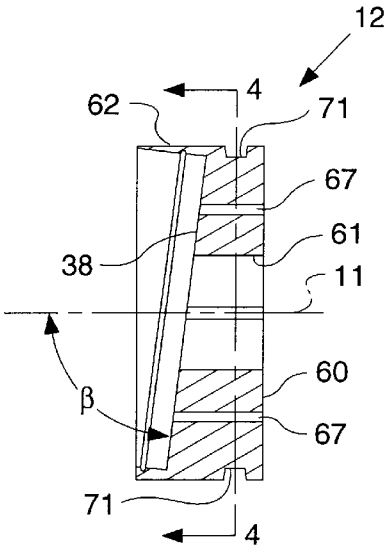
FIG. 3 is a sectioned side view of the drive plate as viewed along section line 3—3 of FIG. 2.
Figure 2:
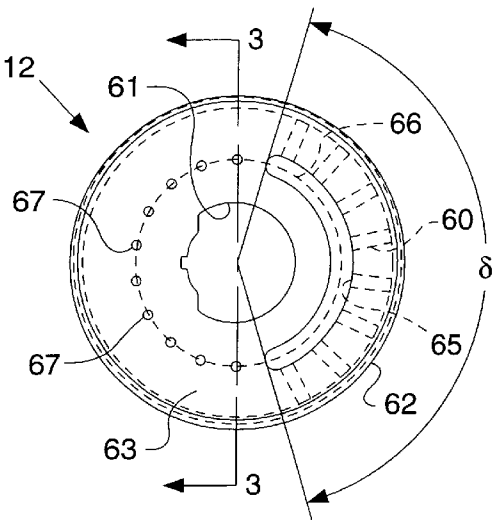
FIG. 2 is a top view of the drive plate included in the present invention.

Referring in addition to FIGS. 2–4, there is shown the metallic drive plate 12 of the present invention. Drive plate 12 has a centerline 11, and a radial inner surface 61 and a radial outer surface 62 which surround the centerline 11. A drive surface 63 extends between outer surface 62 and inner surface 61, and is oriented at a drive angle β which should be different from 90 degrees relative to the centerline 11. Drive plate 12 defines a fill passage 60 which extends between radial outer surface 62 and drive surface 63. Fill passage 60 includes an annular groove 71 which is preferably machined around radial outer surface 62, and a fill slot 65 which opens to drive surface 63. It should be appreciated that the present invention might be designed such that groove 71 was at least partially defined by housing 3 rather than drive plate 12 itself. The cross-sectional area of groove 71 should have sufficient flow area to accommodate the fluid pumping and bearing demands of the pump. The portion of fill passage 60 which connects groove 71 and fill slot 65 can be designed in any suitable manner, so long as adequate flow area is provided. The present description shows, for instance, a plurality of spoke-like bores. However, it should be appreciated that some other design might be employed such as a continuous slot through radial outer surface 62. In the preferred embodiment, till slot 65 is arcuate shaped, and follows a path that has a substantially constant radius, circle 66, relative to centerline 11, preferably sweeping out an angle δ which is less than 180 degrees. As drive plate 12 rotates, the hollow interior 21 of at least one of the plurality of pistons 20 is in fluid communication with inlet 8 via fill passage 60 and annular groove 71.

A base surface 64 is located opposite drive surface 63 and separates radial inner surface 61 from radial outer surface 62. Base surface 64 preferably lies in a plane that is substantially perpendicular to centerline 11, and is separated from housing 3 by a fluid thrust bearing 43. A thrust bearing plate 40 which provides a plurality of thrust pads 42 is positioned beneath fluid thrust bearing 43 (FIG. 1) and drive plate 12. Drive plate 12 defines a plurality of bearing supply passages 67 which extend from base surface 64 through drive surface 63, and provide the fluid for thrust bearing 43. The bearing supply passages 67 are preferably distributed on a circle 66 that is centered on centerline 11 and includes the arc swept out by fill slot 65. In the preferred embodiment, a majority of the radial outer surface 62 is a portion of a regular cylinder and is separated from housing 3 by a fluid journal bearing 44. Hydraulic fluid is pushed into the area between radial outer surface 62 and housing 3 to provide the journal bearing 44. Although preferred, it is not necessary that the present invention include both fluid thrust and fluid journal bearings. A conventional roller bearing might be substituted for either of the fluid bearings provided by the present invention.

INDUSTRIAL APPLICABILITY

Returning now to FIG. 1, the rotation of drive plate 12 causes pistons 20 to reciprocate up and down by elevating and de-elevating the shoes 34 of each piston 20 as the plate passes underneath. The axial lodes produced by piston reciprocation can be balanced by the plurality of thrust pads 42. As drive plate 12 passes underneath one of the pistons 20, drive surface 63 can act on the piston shoe 34 to drive the piston 20 up for a pumping stroke. Each shoe 34 is connected to its respective piston 20 by a ball joint 36 which allows the shoe 34 to remain in continuous contact with drive surface 63. The amount of fluid displaced by the piston 20 into high pressure collector ring 28 depends on the position of its respective sleeve 24. When relatively greater fluid displacement is desired, electro-hydraulic control unit 32 can be used to move sleeves 24 up. The sleeves 24 then cover spill ports 30 and a maximum amount of fluid can be displaced by each piston's 20 pumping stroke to flow past check valve 26 into collector ring 28. By varying the time that the sleeves 24 are held in their up position, a broad spectrum of fluid displacement quantities can thus be obtained.

When drive plate 12 has moved piston 20 its maximum displacement, it begins to move down, its shoe 34 remaining in continuous contact with drive surface 63. Shortly after the piston 20 begins to retract, the rotation of drive plate 12 brings fill slot 65 under the opening 37 in piston shoe 34. Because fluid is continuously supplied via inlet 8 to fill passage 60, the retracting movement of piston 20 acts to draw fluid from fill slot 65 into its hollow interior 21. Because fill passage 60 is supplied with hydraulic fluid directly from inlet 8 rather than the pump's 1 low pressure interior 52, fluid is drawn into the pistons' hollow interior 21 more readily than in prior art pumps. Low pressure interior 52 is preferably fluidly connected to inlet 8 via a pressure balancing passage which is not shown. Shortly before the piston 20 reaches its fully retracted position, the rotation of drive plate 12 moves fill slot 65 out of fluid communication with the opening 38 in piston shoe 34.

As drive plate 12 rotates, fluid which is supplied via inlet 8 is pushed into the area between drive plate 12's radial outer surface 62 and housing 3, resulting in a relatively low friction fluid journal bearing 44. The bearing supply passages 67 which fluidly connect drive surface 63 with base surface 64 allow a continuous supply of fluid to be provided to the area between drive plate 12 and thrust bearing plate 40, constituting the invention's fluid thrust bearing 43. In other words, a portion of the fluid pumped by pistons 20 is pushed through bearing supply passages 67 to produce a fluid thrust bearing 43 that separates drive plate 12 from contact with thrust pads 42. The substitution of conventional roller bearings for the fluid journal 44 and thrust bearings 43 allows the present invention to be manufactured for lower cost and to operate under a significantly decreased frictional load. The present invention represents a further improvement over earlier designs by taking advantage of the fluid supply pressure at the inlet 8 to assist in replenishing the hydraulic fluid in the pistons 20 rather than relying only upon the reciprocating action of the pistons 20 to draw fluid back into their interiors 21.

The above description is intended for illustrative purposes only, and is not intended to limit the scope of the present invention in any way. For example, the fluid bearing design utilized in the present invention might be modified to use a combination of fluid and roller bearings. Additionally, the drive plate-fill passage design might be employed as a means of reducing plumbing in a pump with space constraints.

Thus, those skilled in the art will appreciate that other aspects, objects and advantages of this invention can be obtained from a study of the drawings, the disclosure and the appended claims.

What is claimed is:

1. A drive plate for an axial piston pump comprising:

a metallic component having a centerline and a drive surface oriented at a drive angle that is different from 90° relative to said centerline, and having a radial outer surface surrounding said centerline; and a fill passage disposed in said metallic component and extending between said radial outer surface and said drive surface, said fill passage including an annular groove disposed in said metallic component and opening at said radial outer surface, and said fill passage opening through said drive surface offset from said centerline.

2. The drive plate of claim 1 wherein a portion of said fill passage is a fill slot through said drive surface; and said fill slot following an arc having a substantially constant radius relative to said centerline.

3. The drive plate of claim 2 wherein said arc sweeps out an angle less than 180° about said centerline.

4. The drive plate of claim 2 wherein said metallic component includes a base surface located opposite said drive surface; and said metallic component defining a plurality of bearing supply passages extending from said base surface through said drive surface, and said bearing supply passages being distributed on a circle that includes said arc.

5. The drive plate of claim 1 wherein a majority of said radial outer surface is a portion of a regular cylinder.

6. The drive plate of claim 1 wherein said metallic component includes a base surface separating a radial inner surface from a radial outer surface; and said base surface lies in a plane substantially perpendicular to said centerline.

7. The drive plate of claim 1 wherein said metallic component includes a base surface separating a radial inner surface from a radial outer surface;

said fill passage including an arcuate shaped fill slot disposed in said metallic component and opening at said drive surface, said fill slot being contained within an angle of less than 180° about said centerline; and said metallic component defining a plurality of bearing supply passages extending from base surface through said drive surface.

8. The drive plate of claim 7 wherein said bearing supply passages and said fill slot are distributed on a circle centered on said centerline;

said base surface lies in a plane substantially perpendicular to said centerline; and a majority of said radial outer surface being a portion of a regular cylinder.

9. A pump comprising:

a housing having an inlet;

a plurality of pistons arranged around a centerline, and each of said pistons having a hollow interior;

a rotatable drive plate having a fill passage disposed therein and extending between a radial outer surface and a drive surface, and said fill passage including an annular groove disposed in one of said housing and said drive plate;

said hollow interior of an at least one of said plurality of pistons being in fluid communication with said inlet via said fill passage.

10. The pump of claim 9 including a barrel at least partially positioned in said housing adjacent one end of said plurality of pistons;

said plurality of pistons being oriented parallel to said centerline;

said drive plate having a drive surface positioned adjacent an opposite end of each of said plurality of pistons.

11. The pump of claim 9 wherein said drive plate has a base surface separated from said housing by a fluid thrust bearing; and said drive plate has a radial outer surface separated from said housing by a fluid journal bearing.

12. The pump of claim 9 wherein said drive plate defines a plurality of bearing supply passages extending between said base surface through said drive surface.

13. The pump of claim 9 wherein a majority of said radial outer surface is a portion of a regular cylinder.

14. The pump of claim 13 wherein a portion of said fill passage is a fill slot through said drive surface; and said fill slot following an arc having a substantially constant radius relative to said centerline.

15. The pump of claim 14 wherein said annular groove is defined by said drive plate.

16. The pump of claim 9 wherein said drive plate includes a base surface separating a radial inner surface from said radial outer surface;

said fill passage including an arcuate shaped fill slot through said drive surface, and said fill slot being contained within an angle of less than 180° about said centerline; and said drive plate defining a plurality of bearing supply passages extending from said base surface through said drive surface.

17. The pump of claim 16 wherein said bearing supply passages and said fill slot are distributed on a circle centered on said centerline;

said base surface lies in a plane substantially perpendicular to said centerline; and a majority of said radial outer surface being a portion of a regular cylinder.

18. A method of pumping fluid comprising the steps of:

reciprocating a plurality of pistons at least in part by rotating a drive plate;

fluidly connecting a pumping chamber of a portion of said pistons to an inlet via an annular groove that is a portion of a fill passage extending between a radial outer surface and a drive surface of said drive plate; and fluidly connecting a pumping chamber of a different portion of said pistons to an outlet.

19. The method of claim 18 including a step of adjusting an effective pumping stroke of said pistons at least in part by repositioning a plurality of sleeves surrounding different ones of said pistons.

20. The method of claim 19 including a step of positioning thrust bearing fluid between a base surface of said drive plate and a pump housing; and positioning journal bearing fluid between a radial outer surface of said drive plate and said pump housing.

* * * * *